United States Patent [19]

Schoeffling, Jr.

[11] 4,290,332

[45] Sep. 22, 1981

[54] SOUND SHIELDING AND PICK-UP DEVICE

[76] Inventor: Thomas I. Schoeffling, Jr., 26 Derby Ct., Marlton, N.J. 08053

[21] Appl. No.: 75,900

[22] Filed: Sep. 17, 1979

[51] Int. Cl.[3] ..... G10H 3/00; E04B 1/343

[52] U.S. Cl. ..... 84/1.14; 179/1 AT; 179/1 MF; 179/121 D; 84/453; 181/287

[58] Field of Search ..... 84/1.14, 379, 411 P, 84/453; 179/147, 148 R, 1 AT, 1 MF, 1 E, 121 D; 181/284, 287, 289, 290, 294, 295, 30

[56] References Cited

U.S. PATENT DOCUMENTS

| | | | |
|---|---|---|---|
| 1,655,194 | 1/1928 | Newsom | 181/287 |
| 3,140,564 | 7/1964 | Chapman | 181/287 |
| 3,435,909 | 4/1969 | Wenger et al. | 181/30 |
| 3,768,222 | 10/1973 | Birum, Jr. | 181/287 |
| 3,908,787 | 9/1975 | Wenger et al. | 181/287 |
| 4,019,295 | 4/1977 | Derner et al. | 181/289 |
| 4,047,337 | 9/1977 | Bergstrom | 181/287 |
| 4,227,047 | 10/1980 | Horne | 179/1 E |

FOREIGN PATENT DOCUMENTS

| | | | |
|---|---|---|---|
| 2828413 | 2/1979 | Fed. Rep. of Germany | 181/295 |

OTHER PUBLICATIONS

Brueggemann, "Damping of Sound Energy with Polymer Systems," Modern Plastics, Oct., 1972, pp. 92–96.

*Primary Examiner*—J. V. Truhe
*Assistant Examiner*—F. Isen

[57] ABSTRACT

A pair of sound shielding and pick-up devices to be placed on both sides of a musician facing his audience including plastic sheet sandwiches with sound deadening space between and transducers located at various points on the sheets which are angled concavely toward the musician.

11 Claims, 4 Drawing Figures

SOUND SHIELDING AND PICK-UP DEVICE

BACKGROUND OF THE INVENTION

This invention relates to sound control, sound separation and sound pick-up for a performing musician, whether it be in a recording session or before an audience, when a musician suffers from either being unable to hear the other musicians or being distracted by another musician's playing in close proximity. As an illustration, although this invention is not limited thereto, are the problems associated with the percussion or drum player in the instrumental group. Typically, the drum beat must be heard by the other musicians but must not drown them out or confuse them as can occur with some arrangements. Further, the drum part is typically separated from the other sounds in the electronic sound mixer system. It is undesirable to have other instrumental parts seeping into the percussion recording. In the past, cardboard baffles have been used as well as separate rooms. This has obviously set-up disadvantages, expense problems and is not effective for audience attended sessions. Further, there is always a desire to improve the sound quality, separation and distinctiveness of the recording.

A variety of structures have been used as sound reflecting surfaces, including U.S. Pat. No. 3,409,099 to Wenger, et al., which describes foldable ceiling baffle structures supported from stage rigging to project sound to the audience. U.S. Pat. No. 3,630,309 also to Wenger, et al., describes a portable accoustical shell structure again designed to reflect sound to the audience. An additional Wenger U.S. Pat. No. 3,908,787 discloses a portable accoustical shell directed to the same purposes.

Additional apparatus such as that described in U.S. Pat. No. 1,384,612 to Gray provides a parabolic shape to direct the sound to a particular recording point.

While no prior devices have been located directed to the needs satisfied by my invention, folding guard screen assemblies are described in the prior art such as that in U.S. Pat. No. 3,477,492 to Seuss. Similar structures are described in U.S. Pat. No. 3,497,029 to Stark, U.S. Pat. No. 3,713,474 to Orlando and U.S. Pat. No. 4,057,123 to Erickson.

It is an object of this invention to provide sound shields between a chosen musician and his fellow musicians performing to an audience such that they not interfere with the audience's enjoyment of the performance.

It is an additional object of this invention to provide sound shields that in combination will selectively pick-up the sound of the chosen musician but avoid significant pick-up of sound from the other musicians.

Another object of this invention is to provide devices that will shield the other musicians from interfering sound of the chosen musician, will pick up the sound of that musician and allow for essentially complete separation of the musician's sound within the sound mixing equipment.

An additional object of this invention is to obtain a unique sound effect by pick up of a major portion of the sound of the chosen musician without interferences from neighboring musicians.

An additional object of this invention is to provide sound screen separation without interference of the audience enjoyment or in any way screening the other musicians.

An additional object of this invention is to provide a sound shielding and pick-up device that may be easily set up, is portable and may be easily adjusted to the particular needs of that performance.

A specific object of this invention is to obtain sound separation and pick-up quality, similar to that obtained in a studio, of a performance before an audience.

These objects and others that will become apparent through the balance of this disclosure are not satisfied by the prior art described hereinabove, but are all gained by my invention described hereinafter.

SUMMARY OF THE INVENTION

For simplicity, through this disclosure, the terms "drummer" or "drums" are used to describe my device in shielding a musicial instrument from the balance of the instrumental musicians. It should be understood that my device may be used for any chosen instrument in the group or any part of the instrumental group, including an organ, piano, brass section, or any other instrument or instruments where the effect desired is to separate that particular instrument from the balance of the group for all of the purposes and objects described hereinabove. Therefore, whenever the terms "drummer" or "drums" are used throughout the disclosure, it is not intended to limit the utility of this invention, but merely to describe the use of my device with reference to a particular instrument package.

My invention is a sound shielding and pick-up device which will typically be used in pairs. Each device is essentially identical and is set up to the side and typically on both sides of a performer, such as the drummer, in an instrumental group. In certain limited circumstances, wherein the accoustical set up is unique and the instrument chosen to be separated is on the outside end of the instrumental group as it faces the audience, it is possible that only one device will be necessary. However, for most all situations, a pair of shielding and pick-up devices will be necessary. Placement of the devices on either side of the musician chosen to be separated as he faces the audience at a chosen position to shield other microphones from the sounds of the chosen musician. When placed in this manner, the music from the chosen musician that normally reaches the audience directly will be unimpeded. Similarly, sound traveling away from the audience to be reflected back to the audience through some sort of accoustical shell, will also be unimpeded. However, sound that would normally pass directly to the position of the other musicians will be shielded, and picked up in the device to allow amplification and separation from their music.

My invention is a pair of sound shielding and pick-up devices for placement on either side of a musician facing an audience separating him from the other musicians as above. Each device is essentially identical and includes an upper front face sheet, preferably a plastic sheet such as poly methyl methacrylate. This sheet, as well as the balance of the sheets are preferably sound reflecting sheets with a significant dampering effect to avoid excessive vibration. An upper back face plastic sheet is held by an upper holding system with the upper sheet in a parallel relationship sandwiching a sound deadening space between the sheets. A lower section, similar to that of the upper section is constructed of a lower front face sheet, and a lower back face sheet. A lower holding device holds the lower sheets in a parrallel relationship, again sandwiching a sound deadening space between the sheets. The upper sandwich and the lower sandwich are capable of being angled relative to each other to form a concave angle toward the chosen musician.

A hinge system is attached to the lower edge of the upper sheet sandwich and to the upper edge of the lower sheet sandwich to hold the sandwiches at a chosen concave angle toward the musician. A frame system is provided to hold the sheet sandwiches in any chosen position and at the chosen angle preferably adjustable by the musician to enhance sound pick-up. At least one transducer is connected to each device, each transducer being placed in the front face facing the drummer. It is preferred that there be at least one transducer for each sandwich. Appertures are provided in the front face to allow the transducer to be embedded in the front sheet so as not to significantly impede sound directly reaching the transducer. An electronic sound pick-up system conductively connects each transducer to sound processing equipment, typically capable of sound separation and combination in various modes.

BRIEF DESCRIPTIONS OF DRAWINGS

DESCRIPTION OF PREFERRED EMBODIMENTS

Figure 1:
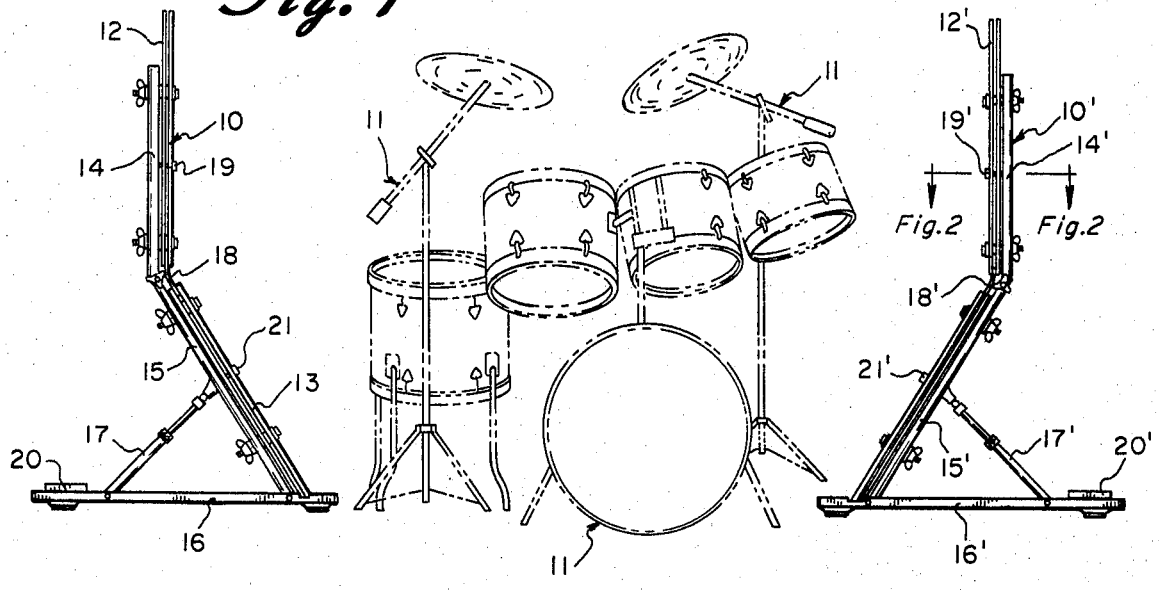
FIG. 1 is a front view roughly from the position of an audience facing the drums of a musician. The musician on either side of which is located the device of the present invention pictured from an edge side view.

Two sound shielding and pick-up devices 10 and 10' are illustrated as viewed from their edges from the audience immediately in front of the drummer and his drum set in FIG. 1. It should be understood that most members of the audience will see either the outside of device 10' and the inside of 10, or vice versa as they are seated in the theater. With my device the audience will have an essentially obstructed view of the drummer and the other musicians in a group on the stage on either or both sides of the drummer.

Drums 11 are shielded on both sides by devices 10 and 10'. It should be understood that while the devices are preferably essentially opposite and parallel to each other, either device 10 or 10' may be angled slightly from the other and from the line of sight to the drummer. The basic components of devices 10 and 10' are illustrated in FIG. 1 including upper sandwich assembly 12 and lower sandwich assembly 13, held in place by upper frame 14 and lower frame 15 which rests on base 16 and supported by angle adjustment assembly 17. Upper sandwich assembly 12 is attached to and held at various angles through hinge assembly 18 to lower sandwich assembly 13. Upper transducers 19 are located on upper assembly 12 and lower transducers 21 are located on lower assembly 13, all electrically connected to preamp 20. Sound shielding and pick-up device 10' is identical to that of device 10 in all respects.

Figure 2:
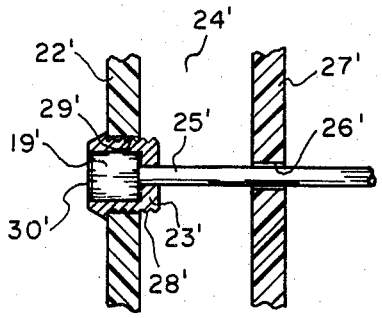
FIG. 2 is a partial cross-sectional view across lines 2—2 of FIG. 1 looking downwardly.

A partial cross-sectional view in FIG. 2 is drawn through lines 2—2 of FIG. 1 looking downwardly shows upper transducer 19' imbedded in upper front sheet 22' with transducer body 23' extending through sheet 22' and into air space 24' connected to 22 guage wire lead 25' which extends through hole 26' in upper back sheet 27'. Transducer body 23' is equipped with threads 28' allowing it to be screwed directly into hole 29' in sheet 22'. The diameter of hole 29' is chosen to be slightly smaller than the threads 28' allowing it to be screwed directly into the PLEXIGLAS sheet without the necessity of threading hole 29'. Sheets 22' and 27' are each $\frac{1}{8}$ inch thick PLEXIGLAS colorless, transparent acrylic cast sheet. The sound pick-up portion 30 of transducer 19' extends slightly past the frontface of sheet 22'. It is preferred that the transducers be imbedded in the front sheets of the particular sandwich where the transducer is located. As shown in the particular embodiment disclosed hereinabove, it is preferred that the transducer extend past the front face so that the sound is picked up at or in front of the front face. The body of the transducer may extend through the sheet and into the airspace between the sandwich and is preferably attached by screwing the transducer directly into a previously drilled hole in the front face.

Figure 3:
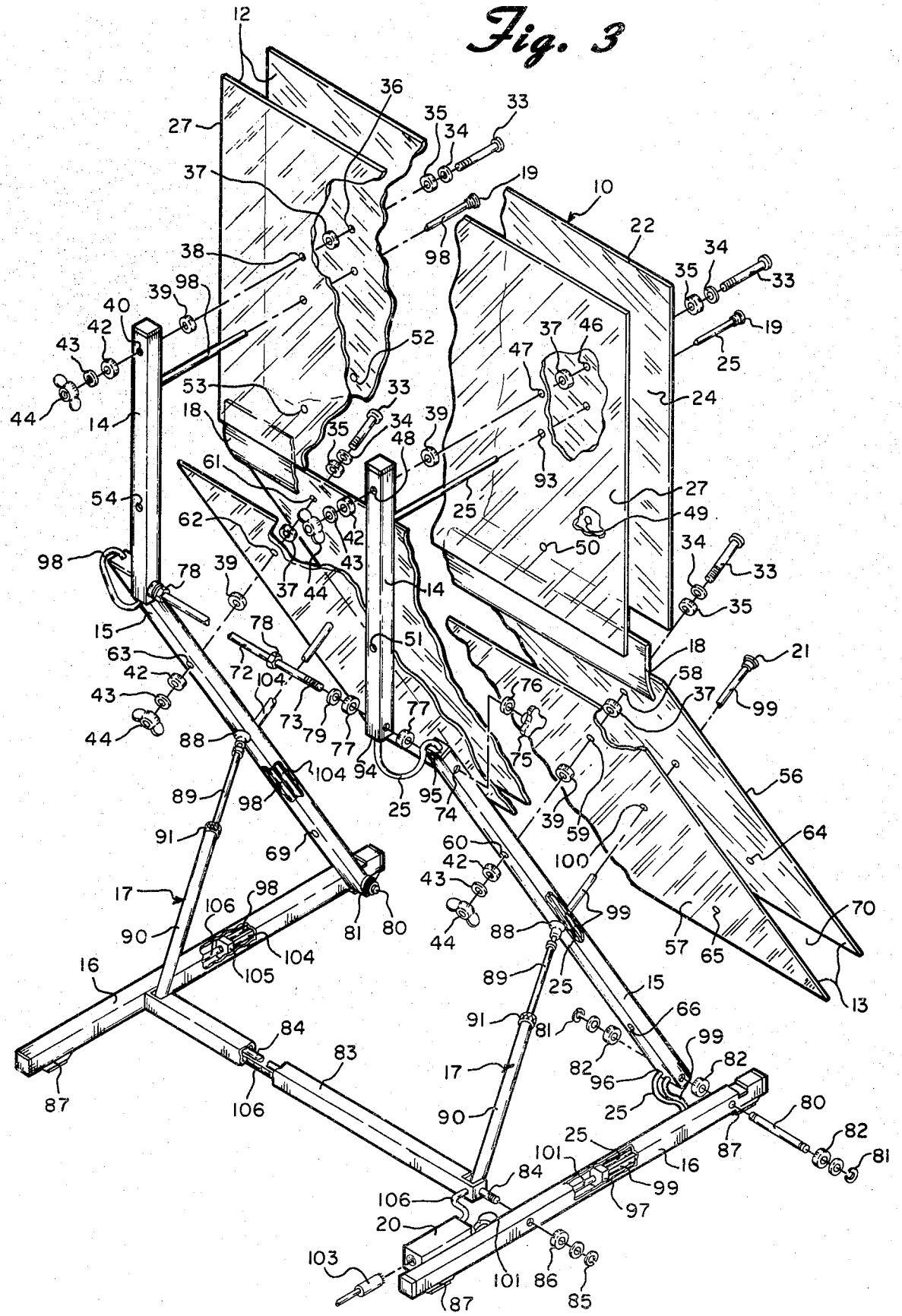
FIG. 3 is an exploded perspective view of one of the devices of this invention pictured in FIG. 1.

FIG. 3 is an exploded perspective view showing the construction details of sound shielding and pick-up device 10. Upper sandwich 12 is constructed of two identical sheets, upper front sheet 22, and upper back sheet 27, each a 60 inch long by36 inch high $\frac{1}{8}$ inch sheet, connected by three inch long $\frac{1}{4}$ inch diameter machine bolt 33 that passes through 1/16 inch metal washer 34 and $\frac{1}{8}$ inch thick sponge rubber washer 35 through hole 36 in sheet 22, through $\frac{1}{2}$ inch thick sponge rubber washer 37, through hole 38, through $\frac{1}{8}$ inch thick sponge rubber washer 39 through upper hole 40 in upper vertical support 14, through $\frac{1}{8}$ inch sponge rubber washer 42, through metal washer 43 and held secure by $\frac{1}{4}$ inch wing nut 44 threaded onto bolt 33. In a similar fashion, identical fastening means connect through hole 46 in sheet 22, hole 47 in sheet 27 and hole 48 in second upper vertical support 14. Two identical attachment devices, although not shown for simplicity, attach through holes 49, 50 and 51 and, in addition, attach through holes 52, 53 and 54. When secured at these four lines, sandwich 12 is held securely to upper vertical frames supports 14. Tightening wing nut 44 compresses the four sponge rubber washers 37 such that space 24 is about $\frac{3}{8}$ inch between sheets 22 and 27.

Lower sandwich assembly 13 is constructed essentially identically to that of upper sandwich assembly 12 and is connected to two lower support members 15. Assembly 13 is constructed of front lower sheet 56 and back lower sheet 57, each sheet being a 60 inch by 36 inch, $\frac{1}{8}$ inch thick sheet of colorless, transparent PLEXIGLAS, sheets 56 and 57 are held together in exactly the same fashion as upper sandwich assembly 12 using the bolt-washers-spacers-wing nut combination, 33 through 44, as was used to hold together assembly 12. This attachment system is shown in the exploded view as passing through hole 58 in sheet 56, through hole 59 in sheet 57 and through hole 60 of lower vertical frame 15. For purposes of simplicity, the individual components of the attachment system, 33 through 44 are not all called out, but are identical to that used for upper sandwich 12. The same attachment system, 33 through 44 is shown passing through hole 61 of front sheet 56, through hole 62 of back sheet 57 and finally through hole 63 of lower vertical frame 15. Although the attachment means 33–44 is not shown for simplicity, the attachment system also passes through holes 64, 65 and 66 as well as holes 67, 68 and 69, all through the lower portion of the lower sandwich assembly 13 and lower vertical frame 15, the latter holes in the sheets being hidden in this view. Space 70 is again about $\frac{3}{8}$ of an inch when the four washers 37 are compressed through attachment system 33–44.

As each sandwich 12 and 13 is constructed, hinge 18 is placed between the sheets at the lower edge of sandwich 12 and upper edge of sandwich 13 to be held securely by pressure of the two sheets. Hinge 18 is of $\frac{1}{2}$ inch thick strip, 3 inches wide and 60 inches long of a highly plasticized, flexible, clear sheet of polyvinyl chloride, slightly thicker than $\frac{3}{8}$ inch thick. Hinge 18 may be attached by adhesive to the inside surfaces of the sheets without significantly reducing ligl.. transmittance through the hinge assembly.

The upper frame members 14 are connected and held at the desired angle and position to lower vertical frame members 15 through $\frac{5}{8}$ inch diameter rod 72 threaded at both ends 73. Rod 72 is held secure through holes 74 (one hidden) in lower vertical frame 15 by tri-wing nut 75 against metal washer 76. Upper frames 14 are held in position on rod 72, sandwiched between rubber washers 77 with pressure applied by nuts 78 against metal washers 79. By loosening tri-wing nut 75 upper vertical frames 14 may be adjusted as to angle, thus positioning sandwich assembly 12.

Lower vertical frame 15 is held in position and connected to base frame 16 through pin 80 notched at both ends on which "C" clip 81 is attached to prevent disengagement. Rubber washers 82 are again used between each metal surface to prevent vibration. Horizontal cross base support 83 is connected between base frame 16 through pins 84 with "C" clip 85 again protected with rubber washer 86. Rubber foot pads 87 are located on the bottom side of all ends of base frames 16 to again reduce vibration and provide leveling. Angle adjustment rods 17 are connected on one end to rod 84 and through ball swivel 88 to lower frame 15. Piston rod 89 slides inside tube 90 and held at any desired position by tightening knurrled adjuster tightener 91. By adjustment of rod 89 the position of sandwich 13 and sandwich 12 may be chosen at will. All of the frame assembly including upper and lower vertical frames 14 and 15, base frame 16 and cross support 83 are constructed of one inch square aluminum tubing.

Upper transducer 19 (there are two shown in device 10) is shown screwed in place into sheet 22 with 22 guage wire leader 25 extending through hole 56 in sheet 27 entering a hole, hidden from view, in the side of upper vertical support 14 with wire lead 25 passing downwardly inside the hollow of support 14 exiting at bottom 94 of support 14 and entering top 95 of lower vertical support 15, threaded inside that support essentially the full length leaving lower support 15 at hole 96, entering the side of horizontal base 16, threaded inside base 16, and connected to a six to four cable junction 97. Similarly, lower transducer 21 (there are two imbedded in sheet 56 one being hidden) is shown screwed in place into sheet 56 with guage 22 wire leader 99 passing through hole 100 in sheet 57 entering a hole hidden from view in the side of lower vertical support 15 passing downwardly inside the hollow, following the same path as wire 25 to cable junction 97. Four wire cable 101 connects directly to CA-3052 pre-amp 20. Nine pin cannon connector 103 plugs directly into pre-amp 20 to connect device 10 electronically with a basic sound system.

Figure 4:
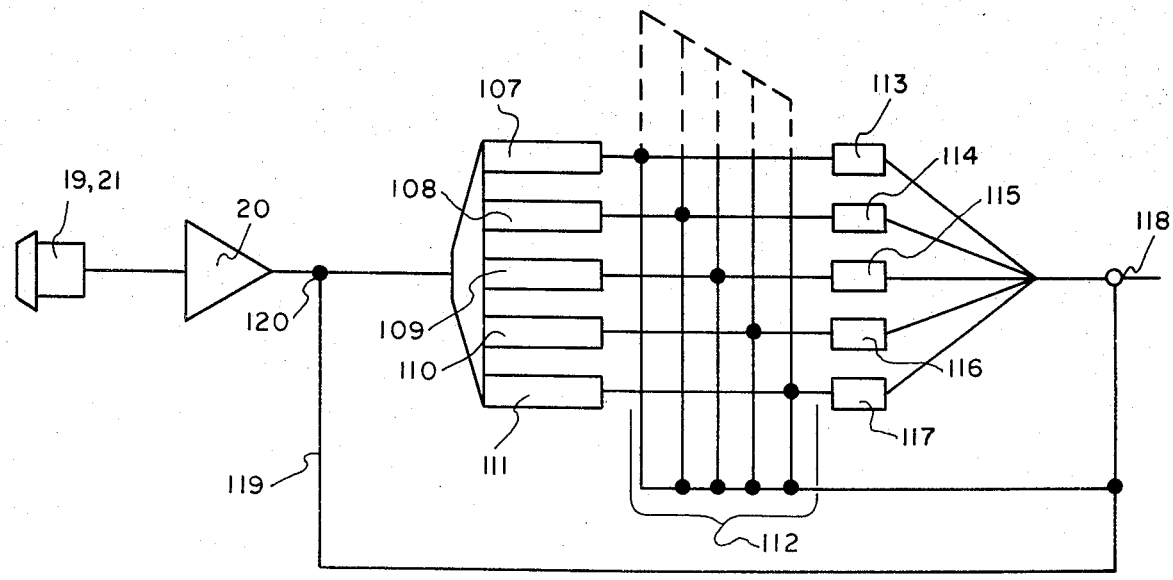
FIG. 4 is a circuit diagram of a sound separation and mixer unit of this invention.

As an optional embodiment, the housing of pre-amp 20 includes a circuit schematically shown in FIG. 4 including transducer 19 or 21 connected to pre-amp 20 connected directly to variable high pass and low pass band filters 107 through 111 passing without amplification through on-off switch 112 to compressors 113 through 117 to balance the loudness without affecting the frequency, with by-pass circuit 119 connected through potentiometer panning control 118, to an output for connection to a standard mixer. In this installation, there would be one such electronic system for each transducer.

The sandwich of PLEXIGLAS sheets provides an essentially dead air space which insulates the sound transmission through device 10. Although it is not shown, it is effective to frame each sandwich around the edges to further reduce the sound transmission through the air space. This frame can be a bead of clear flexible sealant such as silicone rubber or may be a clear plasticized polyvinyl chloride extrusion in a "T" shape or in a "U" shape to fit between the PLEXIGLAS sheets to reduce the sound transmission and also reduce dust and dirt pick-up on the inside of the sandwich.

The angle between upper sandwich assembly 12 and the lower sandwich assembly 13 is preferably in the range of 100° to 170°, more preferably in the range of 120° to 160° and is most preferably at an angle of 140°. Further, the angle of these sandwich assemblies with respect to the floor on which device 10 rests is important in the preferred embodiments of this invention. For example, in the most preferred configuration, it is preferred that upper sandwich assembly 12 tilts at an angle outwardly from the vertical away from the drummer at an angle up to about 10° to an angle inwardly from the vertical toward the drummer at an angle up to about 10°. The angle of vertical to 10° outwardly is more preferred. Further, it is preferred that lower sandwich assembly 13 be tilted upwardly toward the drummer away from the vertical at an angle in the range of about 10° to about 60°, more preferably in the range of 20° to 50° and most preferably in the range of about 30° to about 70° from the vertical. The capability in the frame mechanism to adjust the angle between the sandwiches and their angle relative to the floor is extremely important to my invention, in its preferred embodiments.

As upper sandwich assembly is tilted toward the vertical or even toward the drummer, there is an increasing tendancy to reflect the sound directly back to a drum causing resonance of a part of the instrument and possible feed back to the opposite device 10'. As upper sandwich assembly 12 is tilted further away from the drummer, there is an increading tendency to fail to protect the neighboring instruments of the group from the sound of the drummer. As lower sandwich assembly 13 is tilted toward the vertical away from the drummer, the angle of pick-up from the transducer or transducers located on lower front sheet 56 does not coincide with the angle of sound direction from the instrument. As lower sandwich assembly 13 is tilted toward the drummer, there is an increasing possibility of loss of sound bouncing off the floor and reaching the neighboring instruments in the group.

While this invention has been described with reference to the specific embodiments disclosed herein, it is not confined to the details set forth and the patent is intended to include modifications and changes which may come within and extend from the following claims.

I claim:

1. A sound shielding and pick-up device for use by placement on the side of a musician playing a musical instrument comprising:

(a) an upper front face sheet, (b) an upper back face sheet, (c) an upper holding means to hold the upper sheets in a parallel relationship sandwiching a sound deadening space between the sheets, (d) a lower front face sheet, (e) a lower back face sheet, (f) a lower holding means to hold the lower sheets in a parallel relationship sandwiching a sound deadening space between the sheets, (g) a hinge means between the lower edge of the upper sheet sandwich and the upper edge of the lower sheet sandwich to allow adjustment to form a concave angle between the sandwiches facing the musician, (h) a frame means to hold the sheet sandwiches in any chosen position and at the chosen angle, (i) at least one pickup transducer on at least one of the front faces, and (j) electronic sound pick-up means conductively connecting each said at least one pickup transducer to sound processing equipment.

2. The sound device of claim 1 wherein the face sheets are plastic.

3. The sound device of claim 2 wherein the plastic sheet is colorless transparent polymethyl methacrylate sheet.

4. The sound device of claim 1 wherein frame means has the capability to adjust the angle of sandwiches relative to each other and to the floor.

5. The sound device of claim 4 wherein the frame means is capable to adjusting the angle between the upper sandwiched sheets and the lower sandwiched sheets in the range of 100° to 170°, the concave angle facing the musician to be shielded.

6. The sound device of claim 4 wherein frame means is capable of adjusting the angle of the upper sandwich away from the musician to be shielded up to about 10° from the vertical.

7. The sound device of claim 4 wherein the frame means has the capability of adjusting the angle of the lower sandwich toward the musician to be shielded in the range of about 10° to 60° from the vertical.

8. The sound device of claim 4 wherein the adjustable frame means has capability of adjusting the angle between the upper sandwich and the lower sandwich in the range of 120° to 160° facing the musician to be shielded with the upper sandwich tilted away from the musician up to about 10° from the vertical and the lower sandwich tilted toward the musician at an angle in the range of 30° to 70° from the vertical.

9. The sound device of claim 1 wherein the transducers are screwed into the front face sheet with the sound picked up extending justoutside of the front face.

10. The sound device of claim 1 wherein the hinge means is a flexible sheet held between the lower edges of the upper sheets and between the upper edges of the lower sheets.

11. The sound device of claim 1 wherein there is at least two transducers on each front face.

* * * * *